US012102931B1

(12) United States Patent
Babineau et al.

(10) Patent No.: US 12,102,931 B1
(45) Date of Patent: Oct. 1, 2024

(54) ZIP LINE SYSTEM WITH TURNS AND METHOD OF USE

(71) Applicants: Lloyd Babineau, Lakeside, CA (US); Chris Naire, La Mesa, CA (US); Brian Babineau, Lakeside, CA (US)

(72) Inventors: Lloyd Babineau, Lakeside, CA (US); Chris Naire, La Mesa, CA (US); Brian Babineau, Lakeside, CA (US)

( * ) Notice: Subject to any disclaimer, the term of this patent is extended or adjusted under 35 U.S.C. 154(b) by 0 days.

(21) Appl. No.: 18/642,710

(22) Filed: Apr. 22, 2024

(51) Int. Cl.

| | |
|---|---|
| ***A63G 21/22*** | (2006.01) |
| ***B61B 3/00*** | (2006.01) |
| ***B61B 7/00*** | (2006.01) |
| ***B61B 12/02*** | (2006.01) |

(52) U.S. Cl.
CPC ..... *A63G 21/22* (2013.01); *B61B 3/00* (2013.01); *B61B 7/00* (2013.01); *B61B 12/02* (2013.01)

(58) Field of Classification Search
CPC ..... B61B 12/122; B61B 7/06; B61B 3/00; B61B 7/00; B61B 12/02; B61B 12/00; A63G 21/20; A63G 21/22
See application file for complete search history.

(56) References Cited

U.S. PATENT DOCUMENTS 1,772,005 A * 8/1930 Hoxie ..... B61B 12/02 104/182
3,355,580 A * 11/1967 Wachs ..... B61B 12/00 362/478
8,042,474 B2 * 10/2011 Perakis ..... B61B 12/026 104/173.1
8,166,885 B2 * 5/2012 Kitchen ..... A63G 21/22 104/189
8,499,696 B2 * 8/2013 Tilley ..... B66C 21/02 104/87
8,746,149 B2 * 6/2014 Elhard ..... A63G 21/22 104/189
8,807,044 B2 * 8/2014 Liggett ..... B61B 12/00 105/155
11,207,605 B2 12/2021 Flynn
2009/0078148 A1 3/2009 Cylvick
(Continued)

FOREIGN PATENT DOCUMENTS

KR 101260591 B1 5/2013
KR 102200798 B1 11/2021
(Continued)

OTHER PUBLICATIONS https://www.coaster101.com/2019/09/07/first-ever-cable-to-rail-zip-line-coaster-opens-in-pigeon-forge/; accessed Apr. 22, 2024.
(Continued)

*Primary Examiner* — Zachary L Kuhfuss
*Assistant Examiner* — Cheng Lin
(74) *Attorney, Agent, or Firm* — The Inventor's Friend Patent Law Firm, P.L.L.C.; Nathaniel A. Wickliffe

(57) ABSTRACT

A novel zipline can include banked turns. A rider can ride around turn sections, and the rider can swing out under centrifugal force, extending out at an angle away from the center of the turn. The zipline can be extended, with additional legs added while the zipline remains operational. The zipline can have multiple paths, multiple ending zones, and multiple starting zones. The zipline can be illuminated from within, and can be illuminated with multiple colors.

7 Claims, 16 Drawing Sheets

(56) References Cited

U.S. PATENT DOCUMENTS

| | | | | |
|---|---|---|---|---|
| 2019/0100220 | A1* | 4/2019 | Ciemiewicz | B61B 12/026 |
| 2021/0170285 | A1* | 6/2021 | Wilson | F16D 63/008 |
| 2023/0029168 | A1 | 1/2023 | Liggett | |

FOREIGN PATENT DOCUMENTS

| | | | | |
|---|---|---|---|---|
| KR | 102448817 | B1 | 10/2022 | |
| WO | WO-2015143923 | A1 * | 10/2015 | B61B 7/06 |
| WO | WO-2017178715 | A1 * | 10/2017 | |

OTHER PUBLICATIONS https://www.skywab.com/en/products/thrill-adventures/the-rollercoaster-zipline; accessed Apr. 22, 2024.
https://competition.adesignaward.com/design.php?ID=41496; accessed Apr. 22, 2024.

* cited by examiner

ZIP LINE SYSTEM WITH TURNS AND METHOD OF USE

FIELD OF THE INVENTION

The present disclosure relates generally to the field of zip lines, and more specifically, to a zip line system that can include turns and replaceable modular sections.

BACKGROUND OF THE INVENTION

Zip lining is a popular activity that offers an exhilarating and adventurous experience as participants glide along a cable from generally a higher point to a lower point. Traditional zip lines are commonly straight in their design and operation. More specifically, a conventional zip line consists of a strong cable stretched between two points, typically at different elevations. For zip lining, participants attach themselves to a trolley that moves along the cable. Conventionally, gravity propels the rider from the higher starting point to the lower end point.

Zip lines can be set up in scenic outdoor locations like mountains, forests, or over water bodies, enhancing the thrill with beautiful views. Many adventure or theme parks also have zip line attractions. However, traditional zip lines allow travel in only one direction, from the starting point to the end point. The straight path offers limited experiences. Lack of turns or changes in direction make the ride less interesting and dynamic. Furthermore, if a rider wishes to ride the zipline again, the rider must traverse the entire distance of the ride, and back up hill, to get back to the starting point to ride again.

It would be desirable to have a zipline that can travel through any number of turns and along any number of paths that are not a straight line. It would be further desirable to allows riders to travel around turns at high speeds while experiencing centrifugal force around the turns. It would be further desirable to have a zipline that can end at the same or similar location from the starting point, although at a lower elevation. It would be further desirable to have a zipline with modular and substitutable sections, which would allow for variable experiences, easy replacement, and even multiple passengers in different states of loading for the same zipline.

SUMMARY OF THE INVENTION

This invention overcomes disadvantages of the prior art by providing a novel recreational zipline system. The system described herein allows a zipline to make turns while also allowing the rider to experience the centrifugal force of traveling around turns at high speeds. A zipline can carry a user around one or more curves in a circuitous path that can return back around to be near the starting point, although at a lower elevation. The system described herein further allows an operator to have multiple modular sections and can allow multiple riders to be in different states of loading and/or unloading on the same zipline. The system described herein further can allow a zipline to glow with light and color as a rider is riding the zipline.

In an embodiment, a zipline can include straight sections and turn sections. A trolley can travel along the zipline, and can transition from straight sections to turn sections and from turn sections to straight sections. The trolley can lean outwards at the turn sections, allowing the rider to enjoy the experience of the centrifugal force. The turn sections can include a guide rod that may be placed in such a position that it anticipates the natural centrifugal force a rider might experience. A guide rod can also help to ensure the trolley is at the correct angle for the trolley to pass supports such as spokes, thereby ensuring a smooth and safe ride.

In various embodiments, a zipline system can include a cable, a trolley adapted to ride on the cable, a turn rail supported by a plurality of spokes, the turn rail configured for the trolley to travel on the turn rail in a curved path, and a guide rod attached to the turn rail via a plurality of spacers and adapted to provide correct angling of the trolley during turns and preventing collisions of the trolley with the spokes.

The trolley can include a main body, an upper wheel having an upper waist section, the upper wheel attached to the main body via an upper trolley axle, and a lower wheel having a waist section, the lower wheel attached to the main body via a lower trolley axle, wherein the upper waist section and the lower wheel waist section define a zipline passage between the waist sections of the wheels, the zipline passage adapted to accommodate the cable and adapted to accommodate the turn rail. The upper wheel can include an upper inner wider region and the lower wheel includes a lower inner wider region, and wherein the upper inner wider region and the lower inner wider region define a guide gap adapted to accommodate a guide rod, wherein the guide rod can pass through the guide gap and guide the orientation angle of the trolley as the trolley travels around the turn rail. The upper wheel can include an upper outer wider region and the lower wheel can include a lower outer wider region, and wherein the upper outer wider region and the lower outer wider region define a support gap adapted to accommodate a spoke, wherein the guide rod can guide the orientation angle of the trolley so that the support spokes can pass through the support gap as the trolley travels around the turn rail. The zipline system can include a sheath over the cable, and the upper outer wider region and the lower outer wider region can be close enough together to prevent the sheath over the cable from passing through the support gap. The zipline system can include a translucent sheath over the cable, and wherein a series of LEDs inside the translucent sheath make the sheath emit light.

In various embodiments, a trolley for traveling on a zipline with a turn can include a main body, an upper wheel having an upper waist section, the upper wheel attached to the main body via an upper trolley axle, and a lower wheel having a waist section, the lower wheel attached to the main body via a lower trolley axle, wherein the upper waist section and the lower wheel waist section define a zipline passage between the waist sections of the wheels, the zipline passage adapted to accommodate a zipline and adapted to accommodate a turn rail.

The upper wheel can include an upper inner wider region and the lower wheel can include a lower inner wider region, and wherein the upper inner wider region and the lower inner wider region define a guide gap adapted to accommodate a guide rod, wherein the guide gap is adapted for the guide rod pass through the guide gap and guide the orientation angle of the trolley as the trolley travels around a turn. The upper wheel can include an upper outer wider region and the lower wheel can include a lower outer wider region, and wherein the upper outer wider region and the lower outer wider region define a support gap adapted to accommodate a spoke, wherein the guide rod can guide the orientation angle of the trolley so that the support spokes pass through the support gap as the trolley travels around the turn.

In various embodiments, a method of using a zipline can include suspending a rider below a trolley, the trolley adapted to ride on a cable and the trolley comprising a main body, an upper wheel having an upper waist section, the upper wheel attached to the main body via an upper trolley axle, and a lower wheel having a waist section, the lower wheel attached to the main body via a lower trolley axle, wherein the upper wheel waist section and the lower wheel waist section define a zipline passage between the waist sections of the wheels, the zipline passage adapted to accommodate the cable and adapted to accommodate a turn rail. The method can include travelling along the cable with the rider suspended below the trolley and the trolley riding on the cable, and entering a turn section, the turn section including a turn rail and a guide rod, wherein the guide rod passes between the upper wheel and the lower wheel, and guides the angle of the trolley as the trolley travels around the corner; wherein as the trolley enters the turn section, the trolley transitions from riding on the cable to riding on the turn rail. The method can include swinging outwards under centrifugal force while travelling around the turn section.

BRIEF DESCRIPTION OF THE DRAWINGS

The invention description below refers to the accompanying drawings, of which.

DETAILED DESCRIPTION

There are a great many possible implementations of the invention, too many to describe herein. Some possible implementations are described below. In the following description, for purposes of explanation, numerous specific details are set forth in order to provide a thorough understanding thereof. It should be clear, however, that the innovation can be practiced without various specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, any particular embodiment need not have all the aspects or advantages described herein. Thus, in various embodiments, any of the features described herein from different embodiments may be combined. It cannot be emphasized too strongly, however, that these are descriptions of implementations of the invention, and not descriptions of the invention, which is not limited to the detailed implementations described in this section but is described in broader terms in the claims.

Figure 1B:
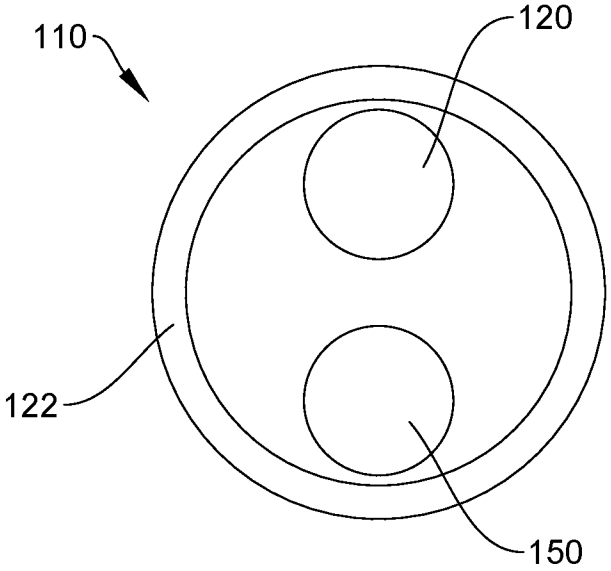
FIG. 1B is a schematic view of a cross section of the straight section of the zipline shown in FIG. 1A, taken along cross section line 1B-1B of FIG. 1A, according to the illustrative embodiment.
Figure 1A:
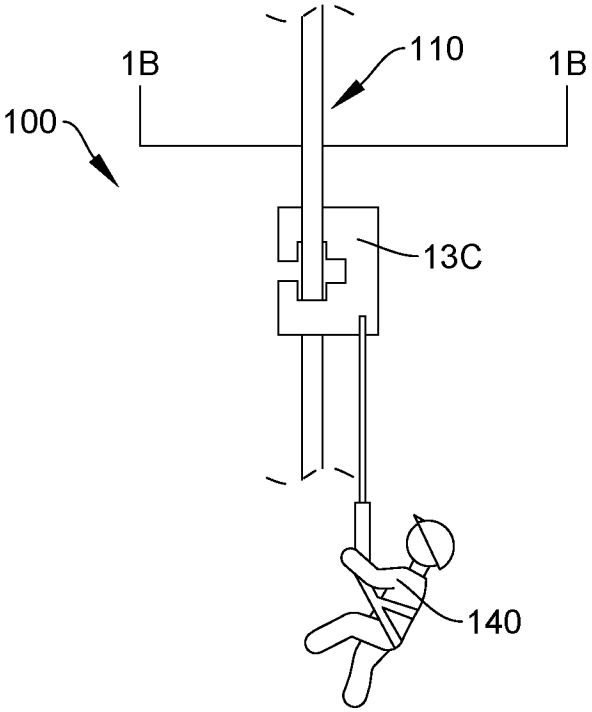
FIG. 1A is a perspective view from behind of a rider traveling along a straight section of a zipline, according to an illustrative embodiment.

The present disclosure describes a novel zipline system and method of use. FIG. 1A is a perspective view from behind of a rider traveling along a straight section of a zipline, according to an illustrative embodiment, and FIG. 1B is a cross section of the straight section of the zipline shown in FIG. 1A. A zipline system 100 can have multiple straight sections of zipline 110 that can include one or more sections of high-strength, flexible cable 120 that can be a steel cable or other appropriate material. The cable can have a flexible tube-shaped cable cover 122 that can be made from a plastic or other appropriate material. A trolley 130 can include an upper wheel that rides on the cable cover 122, and a rider 140 can be suspended down below the trolley 130 and below the zipline 110. The rider 140 can travel along the straight sections of the zipline 110 by riding under the trolley 130 that is travelling over the cable cover 122. In various embodiments, a trolley can ride on a cable with or without a cable cover, however, in the interest of brevity and simplicity, the term "riding on a cable" or "riding on the cable" can refer to riding directly on a cable with or without a cover on the cable.

In various embodiments, the cable cover 122 can be made from a translucent material, and a zipline can have a series of LEDs 150 or other light sources between the cable cover 122 and the cable 120. In various embodiments, the LEDs can be a connected series of LEDs such as a rope-style string of LEDs. This can allow the zipline to appear to light up from the inside while riders are riding the zipline at night.

Figure 2:
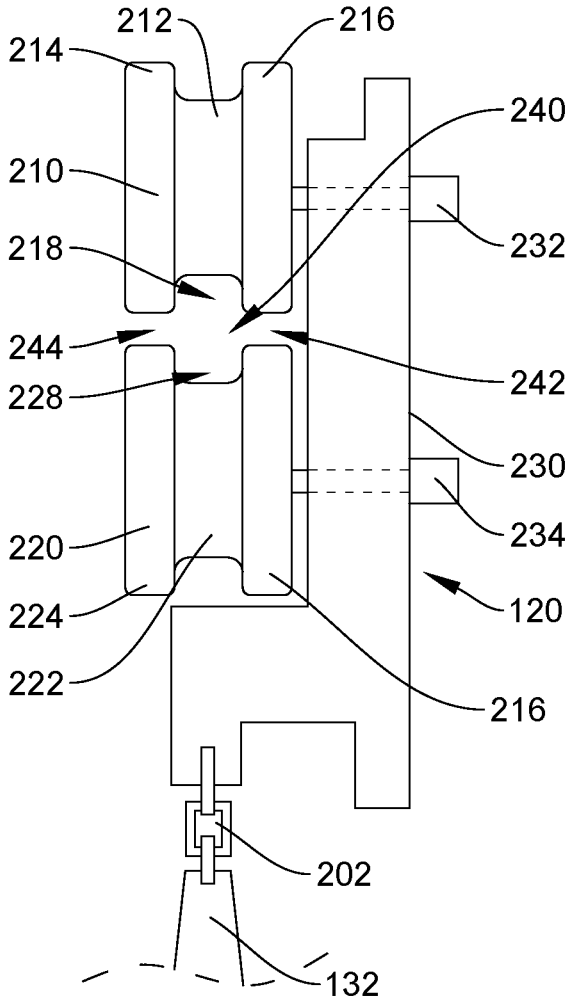
FIG. 2 is a schematic view of a trolley showing the inner workings, according to an illustrative embodiment.

FIG. 2 is a schematic view of a trolley showing the inner workings, according to an illustrative embodiment. A trolley 120 can have an upper wheel 210 and a lower wheel 220. In various embodiments, the upper wheel and lower wheel can be identical. Upper wheel 210 can be rotatably connected to the trolley arm 230 of the trolley 120 by an upper axle 232 that allows the upper wheel to rotate as it rides on the zipline. The upper wheel 210 can ride on the zipline 110, and the upper wheel can support the weight of the rider hanging down below the zipline. The lower wheel 220 can be rotatably connected to the trolley arm 230 of the trolley 120 by a lower axle 234 that also allows the lower wheel to rotate. A rider can be suspended below the trolley in a flexible coupling 202 that can be a chain or other flexible coupling.

Upper wheel 210 and lower wheel 220 can have approximately hourglass shapes. More specifically, the upper wheel can have a narrow waist section 212, and wider regions 214 and 216 on either side of the narrow waist section 212. Upper inner wider region 216 is on the inside, closer to the trolley arm 230, and the upper outer wider region 214 is on the outside, away from the trolley arm 230. The upper wheel 210 can have a channel 218 around the circumference of the wheel, where the channel 218 is defined by the narrow waist section at the bottom of the channel and the wider regions 214 and 216 defining the sides of the channel.

The lower wheel can similarly have a channel 228 that is defined by a narrow waist section 222 at the bottom of the channel and wider regions 224 and 226 defining the sides of the channel 228. Lower inner wider region 226 is on the inside, closer to the trolley arm 230, and the lower outer wider region 224 is on the outside, away from the trolley arm 230. The lower wheel 220 can have a channel 228 around the circumference of the wheel, where the channel 228 is defined by the narrow waist section at the bottom of the channel and the wider regions 224 and 226 defining the sides of the channel.

The axles 232 and 234 can hold the wheels 210 and 220 a fixed distance from each other so that the two channels 218 and 228 define a zipline passage 240. The zipline passage 240 can be an opening between the wheels that is sized to accommodate the zipline. The wider regions of the wheels 216 and 226 that are closer to the trolley arm 230 can define a smaller guide gap 242 between the wheels that is smaller than the zipline passage. The wider regions of the wheels 214 and 224 that are farther out from the trolley arm 230 can define a smaller support gap 244 between the wheels that is smaller than the zipline passage 240. The size of the guide gap 242, which is the distance between the wider regions 216 and 226, is smaller than the size of the zipline, and the size of the support gap, which is the distance between the wider regions 214 and 224, is also smaller than the size of the zipline. In this way, the wider regions are too close together to allow the zipline to pass between the wider regions of the wheels, or put another way, the wider regions of the wheels keep the zipline trapped within the zipline passage 240.

Turning now to FIGS. 1 and 2, as the rider 140 is riding on the zipline 110, the zipline can pass through the zipline passage 240, and the weight of the rider can be carried on the upper wheel 210 as the upper wheel 210 rides along the top of the zipline. The upper wheel 210 and the lower wheel 220 together can secure the zipline within the zipline passage so that the trolley cannot fall off of the zipline.

Figure 3A:
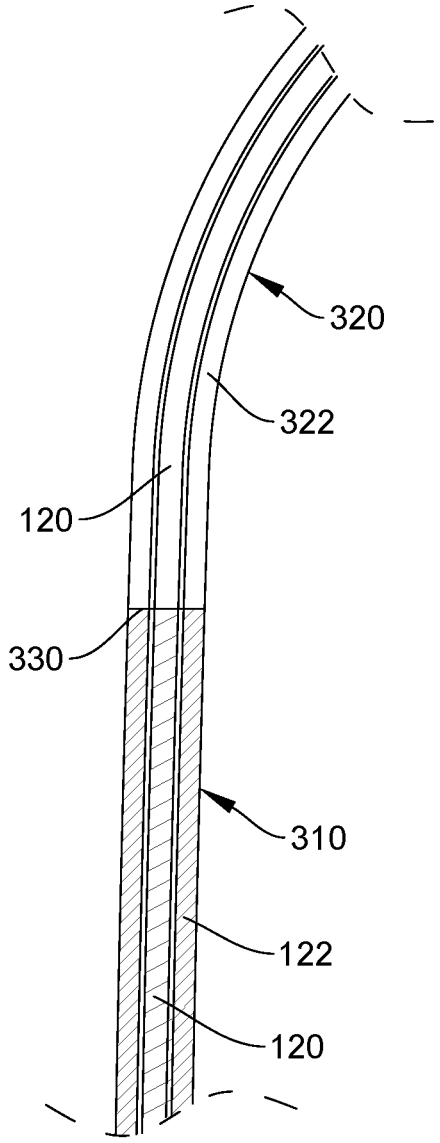
FIG. 3A is a schematic view showing a zipline where a straight section meets a turn section, according to an illustrative embodiment.

FIG. 3A is a schematic view showing a zipline where a straight section meets a turn section, according to an illustrative embodiment. A straight zone 310 of a zipline 110 includes a cable 120 and a cable cover 122. The cable bears the weight of the rider along the straight sections, and the cable cover 122 forms a sheath around the cable 120. The cable cover serves multiple purposes, including providing a protective layer over the cable and increasing the diameter of the cable.

A turning zone 320 of a zipline includes a turn rail 322 that can be a steel pipe or other appropriate rigid material. The turn rail 322 can be a part of the zipline 110, and the turn rail 322 can have a diameter that is the same or similar to the diameter of the cable cover 122. The turn rail can pass through the zipline passage of the trolley when the rider is traveling around the turn.

Figure 3B:
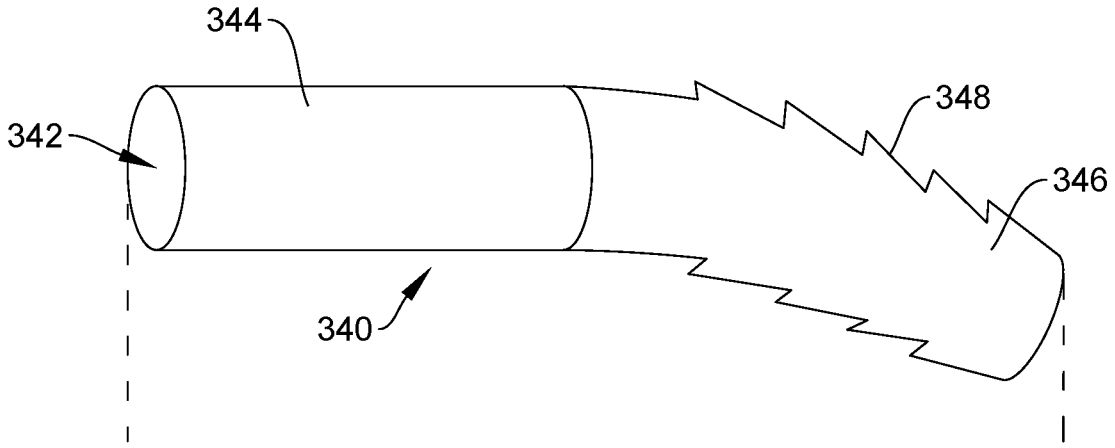
FIG. 3B is a perspective view of a barbed line connector between a cable cover and a turning rail, according to an illustrative embodiment.

The system can have a transition zone 330 between the straight zone 310 and the turning zone 320. In various embodiments, various line connectors can be used in the transition zone 330 to connect a cable cover 122 and a turn rail 322. A line connector can be used to prevent gaps between the cable cover and the turn rail so that the trolley can transition smoothly from one to the other. FIG. 3B is a perspective view of a barbed line connector between a cable cover and a turning rail, according to an illustrative embodiment. A line connector 340 can have a central passage 342 that can accommodate the cable, so that the cable can pass through the line connector 340. The line connector 340 can have a turn rail region 344 and a cable cover region 346. The turn rail region can be inserted into the turn rail and can be secured in place using a set screw, adhesive, or other means. The cable cover region of the line connector can be inserted into the cable cover. The cable cover region can have barbs 348 that can help to prevent the cable cover from separating away from the line connector 340. The cable can pass through the line connector, and the line connector can help to prevent gaps by keeping the cable cover abutted to or close to the turning rail. In various embodiments, the line connector 340 can have an angle between the turn rail region 344 and the cable cover region 346. The angle can accommodate the zipline transitioning between a slope along the straight section to reduced slope along a turn section. In various embodiments, the angle can be approximately 11 degrees between the turn rail region and the cable cover region, although various angles are possible to accommodate various sloped ziplines.

Figure 3C:
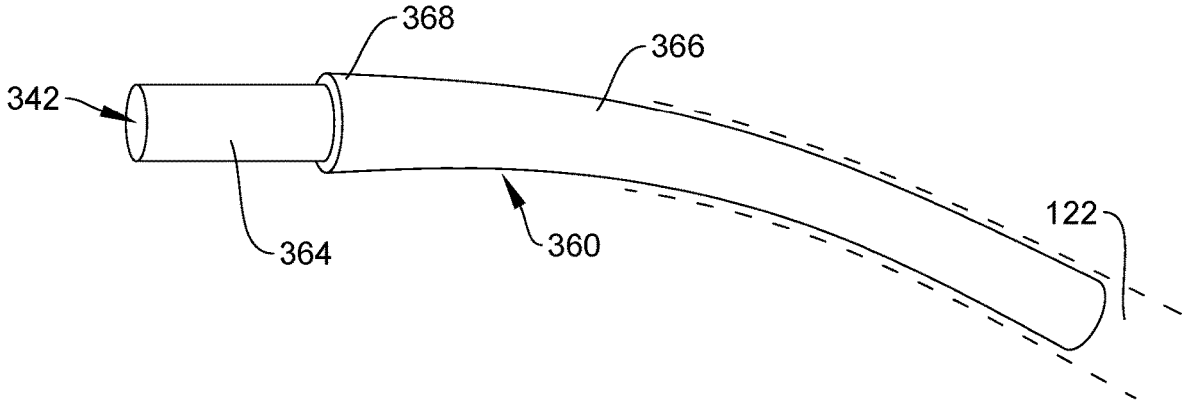
FIG. 3C is a perspective view of a flared line connector between a cable cover and a turning rail, according to an illustrative embodiment.

FIG. 3C is a perspective view of a flared line connector between a cable cover and a turning rail, according to an illustrative embodiment. In various embodiments, a line connector 360 can have a turn rail region 364, a tapered region 366, and a flared region 368. The turn rail region can be inserted into the turn rail, and the tapered region can be inserted into the cable cover 122. The flared region 368 can flare out to match the size of the turn rail. Put another way, the maximum exterior diameter of the flared region can be approximately the same as the exterior diameter of the turn rail. The exterior diameter of the tapered region 366 can be slightly smaller than the interior diameter of the cable cover 122, so when that the tapered region 366 is inserted into the cable cover, the transition from the cable cover to the line connector can include a step that can be approximately the same height as the thickness of the cable cover, resulting in a more smooth transition for a rider.

Figure 4:
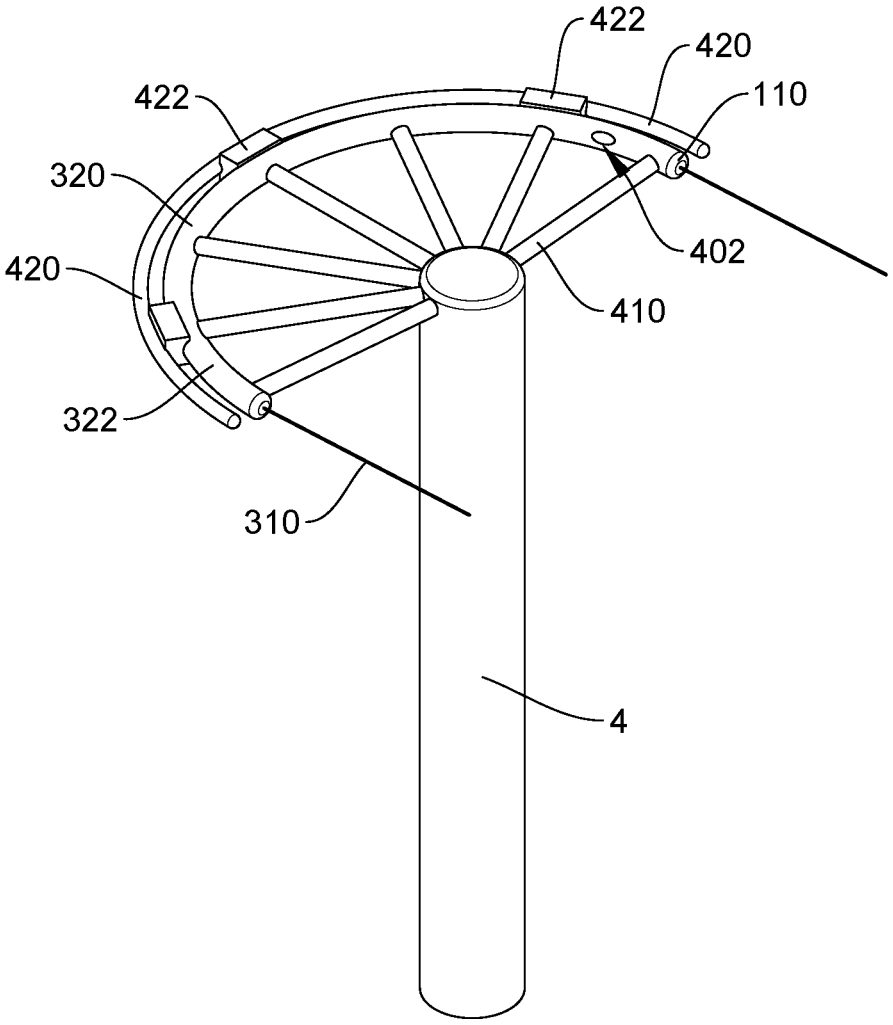
FIG. 4 is a perspective view of turn zone and two straight zones, according to an illustrative embodiment.

FIG. 4 is a perspective view of turn zone and two straight zones, according to an illustrative embodiment. Turning now to FIGS. 3 and 4, at the transition zone 330 between the straight zone 310 and the turning zone 320, the cable 120 can enter the turn rail 322. In various embodiments, the turn rail can be a pipe, and the cable 120 can pass through the pipe. In various embodiments, the cable can be a single cable that can enter the rail at one end of the turning zone and can pass through the length of the rail and out the other end of the rail at the end of the turning zone to continue in the next straight section. In various embodiments, the cable can enter the rail at one end, and can exit the rail through an opening 402 on the support side of the rail 322, so that the cable 120 can be tied off or otherwise affixed to the rail, with two separate cables at the two ends of the turning zone 320.

The weight of the rider is supported on the cable in the straight zone, and the weight of the rider is supported on the rail in the turn zone. The cable cover 122 and the rail 322 can have the same diameter, and the cable cover can abut against the rail, so that the trolley can travel smoothly from the straight zone 310 through the transition zone 330 to the turning zone 320. In the straight sections, the cable is supported at both ends of the straight zone, and is suspended between those two ends. In the turn zone, the turn rail is supported by spokes 410 that can extend out from a center pole.

Turning to FIGS. 2 and 4, as the trolley 130 travels around the turn rail 322, the support spokes 410 are able to pass through the support gap 244 in the side of the trolley. It should be clear that the spokes are strong enough to support the rider and the turn rail, while also being thin enough at the ends to pass through the support gap. In various embodiments, a spoke may have various brackets and/or connectors at the end of the spoke where the spoke connects to the turn rail.

Figure 5:
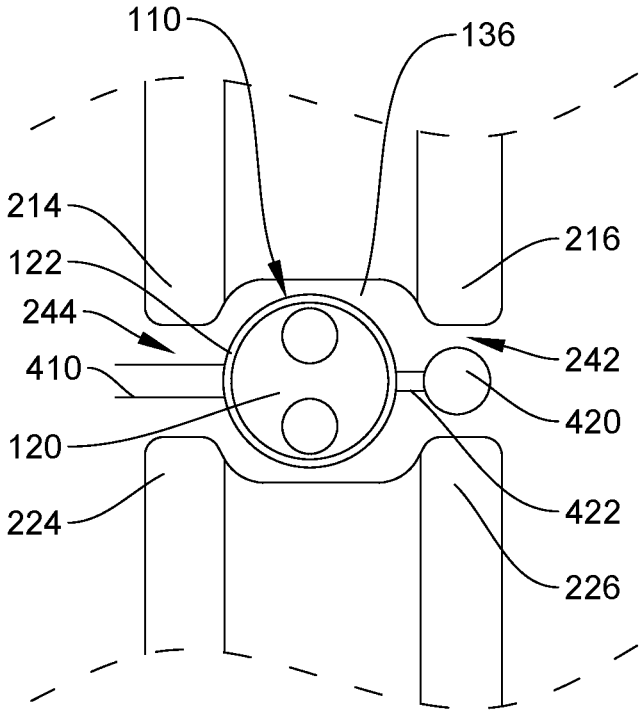
FIG. 5 is an enlarged view of the wheels of FIG. 2 with a turn rail in the zipline passage and a guide rod in the guide gap, according to an illustrative embodiment.

The turn section can have a guide rod 420. Spacers 422 connect the guide rod 420 to the turn rail 322 so that the guide rod 420 is supported by the turn rail 322. FIG. 5 is an enlarged view of the wheels of FIG. 2 with a turn rail in the zipline passage and a guide rod in the guide gap, according to an illustrative embodiment. Turning now to FIGS. 4 and 5, as the trolley passes the transition zone 330 from the straight section 310 to the turn section 320, the guide rod 420 enters the guide gap 244 of the trolley 130. The guide rod 420 can ensure that the trolley 130 is at the correct angular orientation so that the support spokes 410 pass through the support gap 242. In the straight zone, the trolley can hang down directly below the cable. As the trolley crosses the transition zone, the guide rod enters the guide gap while the trolley is hanging down straight.

Figure 6:
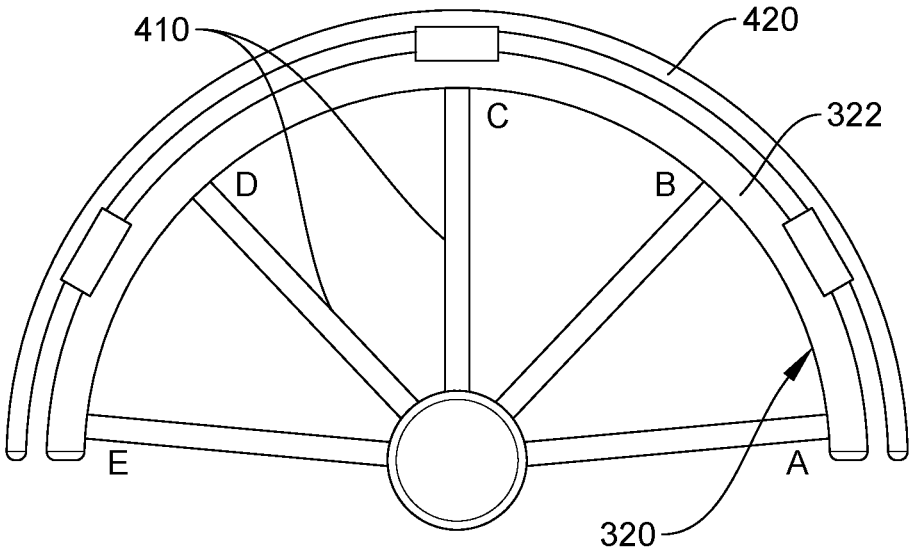
FIG. 6 is a schematic view showing the relationship between the turning rail and the guide rod through a turn, according to an illustrative embodiment.

FIG. 6 is a schematic overview showing the relationship between the turning rail and the guide rod through a turn, according to an illustrative embodiment, FIGS. 7A-7E are schematic views showing the orientation of the guide rod relative to the turning rail at different positions around the turn, according to an illustrative embodiment, and FIGS. 8A-8E are schematic views of the angle of the trolley and rider at the different positions around the turn, according to the illustrative embodiment. As shown in FIG. 6, the guide rod is positioned horizontally to the side of the turning rail at the beginning of the turning zone. throughout the turn, the guide rod transitions to a position above the turning rail, and then can transition back to a position that is horizontally to the side of the turning rail by the end of the turn.

Figure 7A:
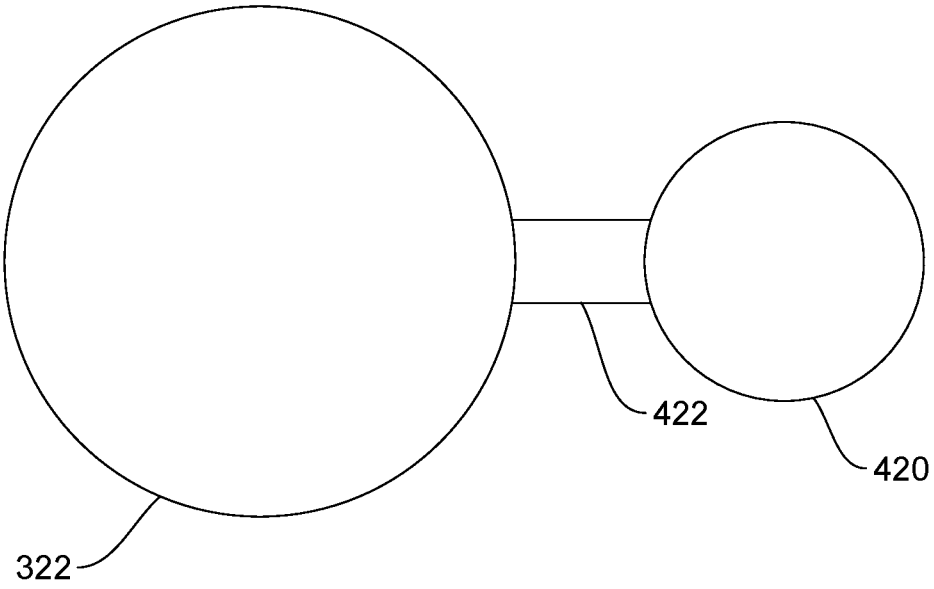
FIGS. 7A-7E are schematic views showing the orientation of the guide rod relative to the turning rail at different positions around the turn, according to an illustrative embodiment.
Figure 7A:
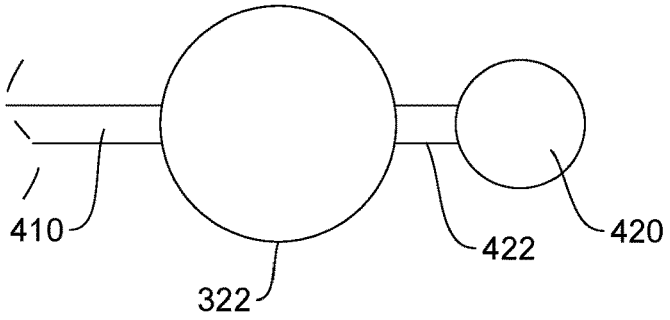
Figure 8A:
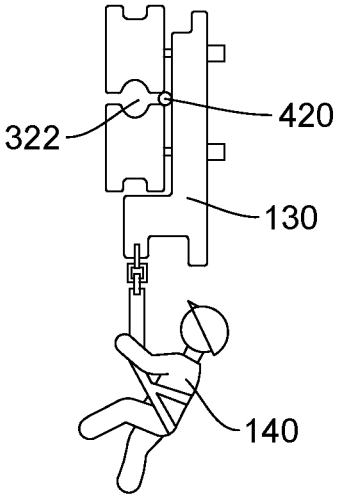
FIGS. 8A-8E are schematic views of the angle of the trolley and rider at different positions around the turn, according to the illustrative embodiment.

As the rider enters the turning zone 320 at position A in FIG. 6, FIG. 7A shows the orientation of the guide rod relative to the turning rail at position A, according to an illustrative embodiment, and FIG. 8A shows the orientation of the trolley and rider when the trolley is at position A, according to an illustrative embodiment. At position A, the guide rod and the turning rail are side-by-side, with the guide rod extending out to the side of the turning rod. At position A, the guide rod is horizontally oriented relative to the turning rail, or put another way, the relationship of the guide rod to the turning rail is 0 degrees relative to the horizon. When the rider 140 is travelling in a straight line, just before entering the turning zone, the rider hangs down vertically below the trolley, and the trolley is oriented with the guide gap of the trolley extending out horizontally to the side of the zipline passage. At position A, the trolley and rider are vertically oriented, and the guide rod 420 that is horizontally oriented to the turning rail 322 has just entered the guide gap.

Figure 7B:
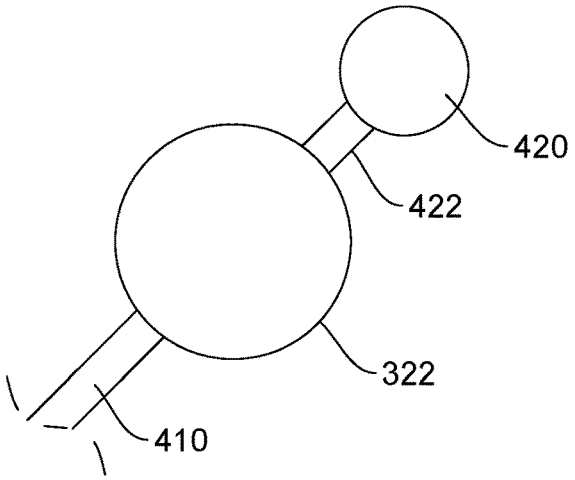
Figure 8B:
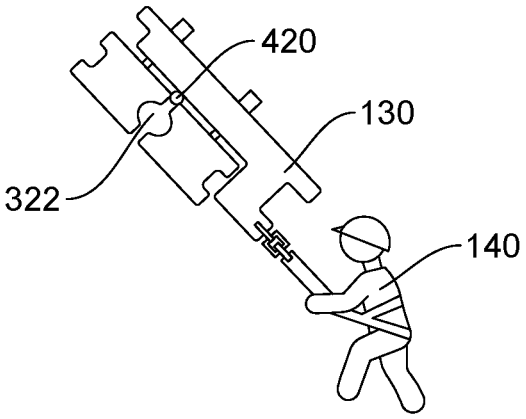

At position B in FIG. 6, the rider 140 has begun to travel around the corner. As the rider reaches position B in FIG. 6, FIG. 7B shows the orientation of the guide rod 420 relative to the turning rail 322 at position B, and FIG. 8B shows the orientation of the trolley 130 and rider 140 when the trolley is at position B, according to an illustrative embodiment. By way of non-limiting example, at position B the guide rod 420 can be oriented at 45 degrees from horizontal relative to the turning rail 322, however, it should be clear that this is merely an illustrative example, and any angle is possible, including angles that are larger or smaller than 45 degrees. As the rider begins to travel around the corner, centrifugal force pushes the rider outward away from the center of the turn, and the rider can be, by way of non-limiting example, extending outwards around the corner at approximately 45 degrees. The guide rod works together with the centrifugal force. As the rider is being pulled outwards by the centrifugal force, the guide rod ensures that the trolley is also tilting outwards at the same angle and at the same time. In various embodiments, the rider can be swinging out at a 45-degree angle, and the guide rod can guide the trolley to the same angle, so the trolley and rider can remain aligned.

The guide rod can anticipate the centrifugal force exerted on the rider and trolley. As the rider experiences the centrifugal force, the rider swings outwards at an angle. The guide rod can anticipate the angle of the rider due to the centrifugal force, and the guide rod can help to ensure the trolley is the same angle for all riders, regardless of size, weight, or speed. The guide rod may affect the angle of the trolley, depending on the rider, to ensure a uniform ride and uniform angle, however, in those cases where the guide rod is affecting the angle of the trolley, the guide rod itself is not causing the rider to swing out or causing the trolley to tilt at an angle but is merely adjusting the angle to be uniform among riders. This minor adjustment to the angle to ensure uniformity ensures that the trolley is always at the correct angle for the support spokes to pass correctly through the support gap of the trolley while also allowing the rider to swing outwards while experiencing centrifugal force.

Figure 7C:
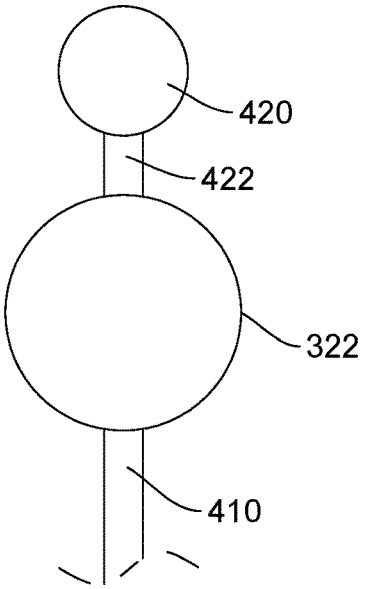
Figure 8C:
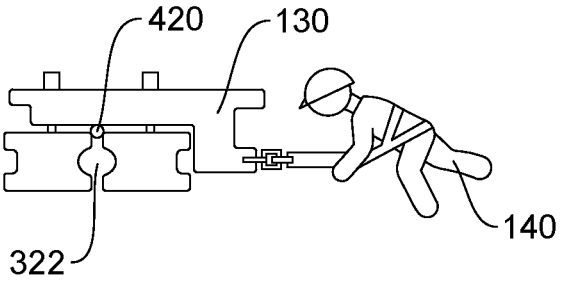

At position C in FIG. 6, the rider 140 has reached the apex of the corner. As the rider reaches position C in FIG. 6, FIG. 7C shows the orientation of the guide rod 420 relative to the turning rail 322 at position C, and FIG. 8C shows the orientation of the trolley 130 and rider 140 when the trolley is at position C, according to an illustrative embodiment. By way of non-limiting example, at position C the guide rod 420 can be extending upwards, oriented at 90 degrees from horizontal relative to the turning rail 322, however, it should be clear that this is merely an illustrative example, and any angle is possible, including angles that are larger or smaller than 90 degrees. As the rider reaches the apex of the corner, centrifugal force pushes the rider outward away from the center of the turn to a maximum outward position, and the rider can be, by way of non-limiting example, extending outwards around the corner at approximately 0 degrees relative to horizontal. The guide rod continues to work together with the centrifugal force. As the rider is being pulled outwards by the centrifugal force, the guide rod ensures that the trolley is also tilting outwards at the same angle and at the same time. In various embodiments, the rider can be swinging out at a 90 degree angle at the apex of the turn, and the guide rod can guide the trolley to the same angle, so the trolley and rider can remain aligned.

Figure 7D:
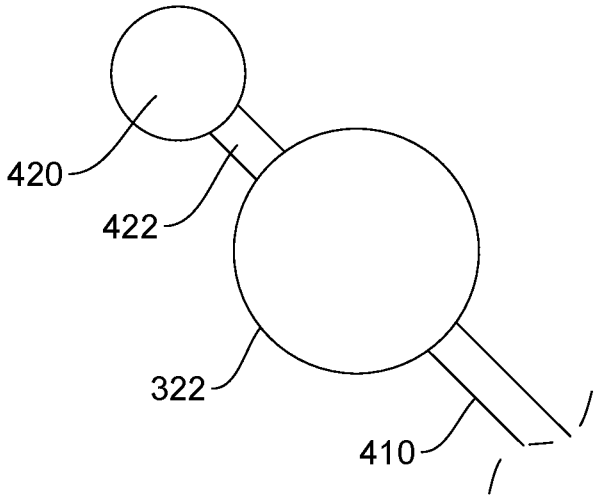
Figure 8D:
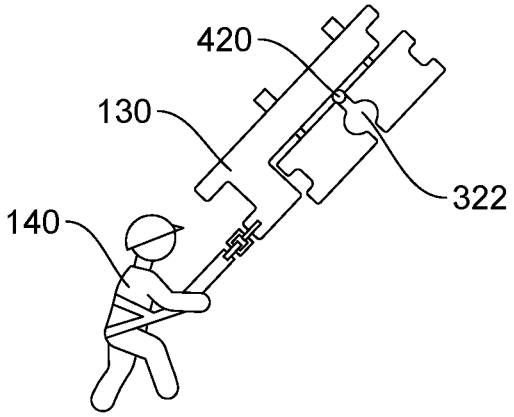

At position D in FIG. 6, the rider 140 has passed the apex of the corner. As the rider reaches position D in FIG. 6, FIG. 7D shows the orientation of the guide rod 420 relative to the turning rail 322 at position D, and FIG. 8D shows the orientation of the trolley 130 and rider 140 when the trolley is at position D, according to an illustrative embodiment. By way of non-limiting example, at position D the guide rod 420 can be oriented at 45 degrees from horizontal relative to the turning rail 322, however, it should be clear that this is merely an illustrative example, and any angle is possible, including angles that are larger or smaller than 45 degrees. As the rider passes beyond the apex of the corner, centrifugal force can decrease, and the angle the rider is being pushed outward also decreases, and the rider can be, by way of non-limiting example, extending outwards around the corner at approximately 45 degrees relative to horizontal. The guide rod continues to work together with the centrifugal force. As the centrifugal force decreases and the angle to which the rider is being pushed outward is decreasing, the guide rod ensures that the trolley is also returning to a reduced angle at the same time. In various embodiments, the rider can be returning to a 45 degree angle, and the guide rod can guide the trolley to the same angle, so the trolley and rider can remain aligned.

Figure 7E:
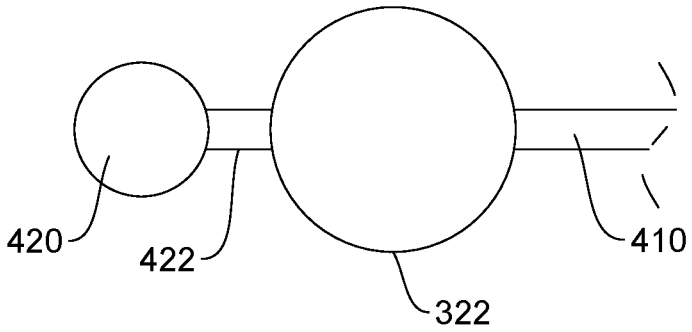
Figure 8E:
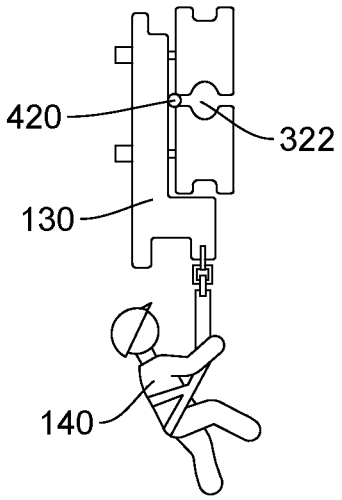

At position E in FIG. 6, the rider 140 has passed the apex of the corner. As the rider reaches position E in FIG. 6, FIG. 7E shows the orientation of the guide rod 420 relative to the turning rail 322 at position E, and FIG. 8E shows the orientation of the trolley 130 and rider 140 when the trolley is at position E, according to an illustrative embodiment. By way of non-limiting example, at position E the guide rod 420 can be oriented at 0 degrees from horizontal relative to the turning rail 322. As the rider reaches the end of the corner, centrifugal force can be significantly decreased, and the angle the rider is being pushed outward can also be significantly decreased, and the rider can be, by way of non-limiting example, hanging down approximately vertically below the turning rail. The guide rod continues to work together with the centrifugal force. As the centrifugal force continues to decrease and the angle to which the rider is being pushed outward continues to decrease, the guide rod ensures that the trolley is also returning to a reduced angle at the same time. In various embodiments, the rider can be returning to a vertical orientation below the zipline, and the guide rod can guide the trolley to the same angle, so the trolley and rider can remain aligned.

This system allows the rider to safely experience the centrifugal force of traveling around a corner at high speeds. If the system did not allow the trolley to tilt through the corners, and the trolley was maintained in a vertical orientation throughout the corner, the force of the rider pulling outwards from the bottom of the trolley would work against the system resulting in excessive force and wear on the system while also preventing the rider from fully enjoying the centrifugal force of the turn. The system described herein allows the trolley to tilt at a natural angle caused by the centrifugal force, while also ensuring that the trolley tilts at the same angle for all riders, regardless of the weight of the rider.

As described herein, the guide rod ensures that the trolley tilts outwards at the same angle for all riders, regardless of the weight of the rider, and this angle is approximately the natural angle that the rider and trolley would tilt at under centrifugal force. The guide rod guides the trolley to tilt outward at an angle that mimics the angle of travel under centrifugal force as the rider travels around the corner. By guiding the tilt of the trolley, the guide rod also ensures that the trolley tilts to the correct angle for the support spokes to pass through the support gap. As shown in FIGS. 6, 7A, and 8A, the support spoke can be at a horizontal angle at position A, and the guide rod will ensure that the trolley is at the correct angle for the support spoke to pass safely through the support gap as the trolley passes the support spoke. Similarly, at position B, the support spoke can meet the turning rail at a 45-degree angle, and the guide rod will ensure that the trolley is at the correct angle for the support spoke to pass safely through the support gap as the trolley passes the support spoke. At position C, the support spoke can be vertical where the support spoke meets the turning rail, and the guide rod will ensure that the trolley is at the correct angle for the support spoke to pass safely through the support gap as the trolley passes the support spoke. In various embodiments, the spokes can connect directly to the turning rail, and/or various brackets may be used to connect the turning rail to the spokes.

It should be clear that the specific angles shown in FIGS. 6, 7A-7E, and 8A-8E discussed herein are only intended to be examples and are used to help illustrate the concepts. In various embodiments, different angles may be possible. The angles can be designed to align or approximately align with the centrifugal force of an average rider. Different speeds in different sections, and different shapes of turns can all affect the centrifugal force and the desired angles. In various embodiments, it may be possible to add additional weight for lighter weight riders, so that all riders can enjoy a similar experience. In various embodiments, weight can be added by adding water to a bladder associated with the trolley or harness, so that all riders can quickly be brought to the same weight.

In various embodiments, a zipline can incorporate one or more turn sections so that the zipline can be an exciting ride around high-speed corners and an unlimited number of path designs. In various embodiments, a zipline can travel a circuitous path with one or more turns and can return to an end point that can be close to the starting point, although at a lower elevation.

Figure 9:
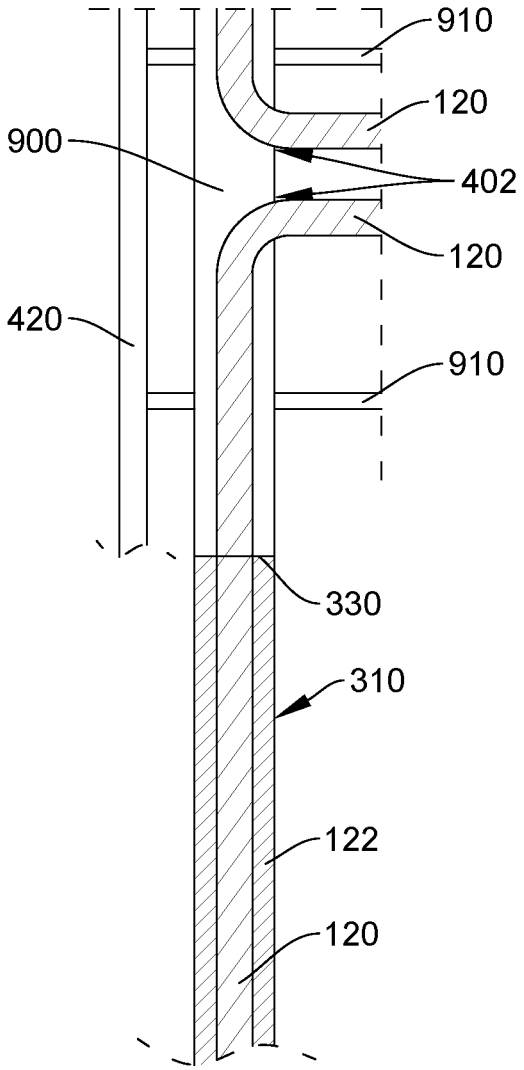
FIG. 9 is a schematic view of a transition zone showing a cable that ends in the middle of the ride, according to an illustrative embodiment.

FIG. 9 is a schematic view of a changeover zone showing a cable that ends in the middle of the ride, according to an illustrative embodiment. In various embodiments, a rail can have two distinct cables at the two ends of the rail. In various embodiments, a rail can be part of a turning zone, or can be a straight rail 900 that allows for a transition from one cable 120 to another cable 120, or even a chance to select between different paths on different cables. The rail 900 can be a hollow pipe, and the hollow pipe can have supports 910, such as spokes or other supports, that extend out from a support side of the rail 900. The rail 900 can have an opening 402 on the support side of the pipe. The cable can enter the pipe at the transition zone 330, and the cable can exit the pipe through the support-side opening 402. The cable can then be secured in various ways such as being tied off at the rail or secured to a nearby pole. As the trolley passes the cable extending out from the pipe, a guide rod 420 can ensure that the trolley is oriented so that the cable end sticking out from the side of the rail passes through the support gap.

The trolley has a support gap that allows the zipline to have rigid supports in various sections, and the guide rod ensures that the trolley is aligned correctly so that anything sticking out from the side of the zipline, such as supports or cable ends, can safely and reliably pass through the support gap as the trolley travels down the zipline. This allows for an unlimited zipline system. A zipline system can have various modular sections that can include an unlimited number of cable sections. Each cable section can be tied off a transition zone, and the trolley can seamlessly pass over the transition zones passing from cable to rail to cable again. In this way, a single zipline ride can extend for miles without the need for a single cable to extend the entire distance. A zipline can also be added to over time. A zipline operator can start with one or more cable sections in a single ride, and can add additional cable sections to extend the ride later.

Figure 10:
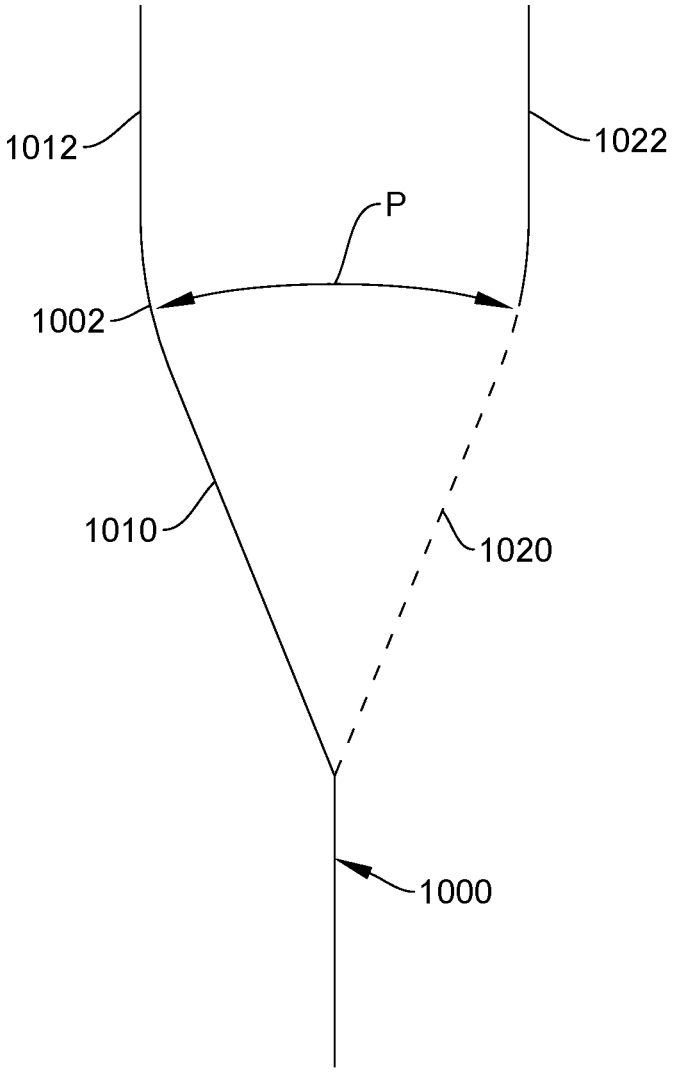
FIG. 10 shows a schematic view of a switching rail, according to an illustrative embodiment.

Similar to the way train tracks can move so that a train can switch tracks, different sections of zipline rail can also be moved. FIG. 10 shows a schematic view of a switching rail, according to an illustrative embodiment. A mobile section of a rail can move between multiple positions to change the travel direction of a rider. As shown, a rail section 1000 can transition back and forth along arrow P between position 1010 and position 1020. The flexible rail section 1000 can flex enough to allow the end 1002 of the flexible rail 1000 to meet path 1012 or path 1022. This can allow a zipline to have a forked path, and rider can travel down one path or the other, depending on the position of a switching rail. This can also be used to switch back and forth between different landing zones or different loading zones. For example, a first rider can end the ride at a landing zone on path 1012. While the first rider is getting out of the harness or otherwise getting off of the ride on path 1012, the flexible rail section 1000 can switch to position 1020, and a new rider can begin the ride towards a landing zone on path 1022. Similarly, a ride can have multiple loading zones, with multiple riders in different states of loading. A flexible rail section can allow riders from different loading zones to transition onto the same zipline.

Figure 11B:
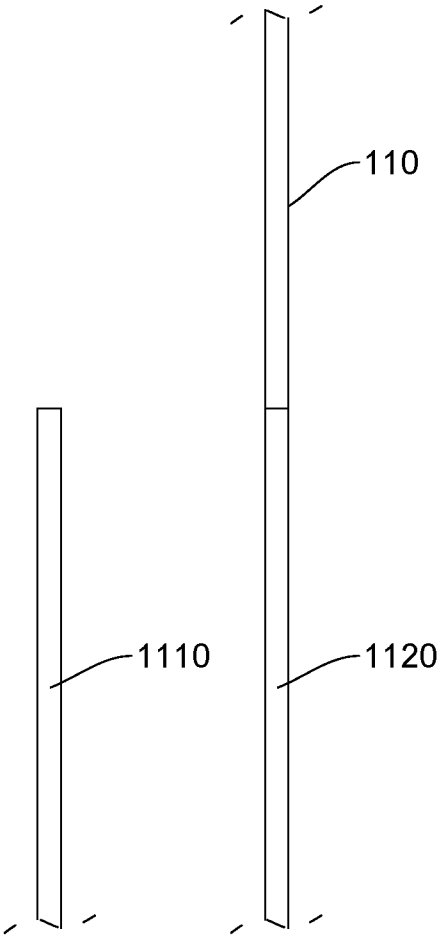
FIG. 11B shows a schematic view of multiple loading zones with the second loading zone moved into place at the start of the zipline, according to an illustrative embodiment.
Figure 11A:
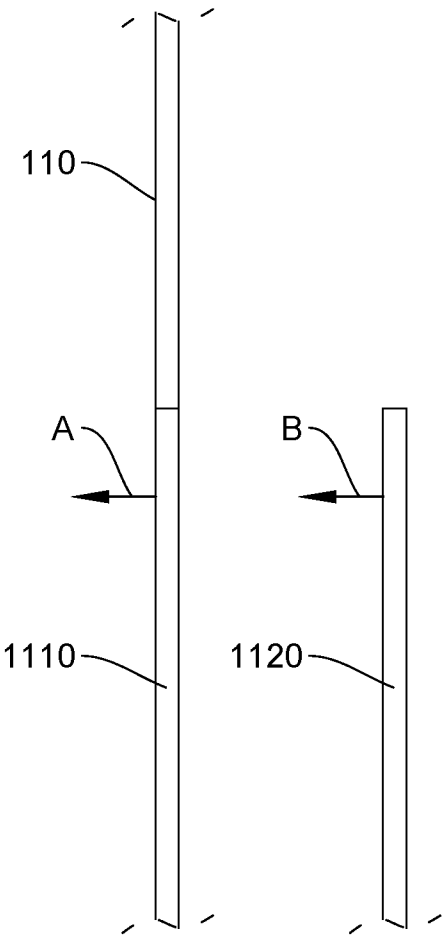
FIG. 11A shows a schematic view of multiple loading zones, according to an illustrative embodiment.

FIG. 11A shows a schematic view of multiple loading zones, according to an illustrative embodiment. In various embodiments, multiple loading zones can have rails that can move into and out of place at the start of the zipline. As a first rider is starting the ride from a first loading zone 1110, a next rider can be getting harnessed in on a second loading zone 1120. As the first rider reaches the landing zone, the rail of the first loading zone can move out of the way in the direction of arrow A, and the rail of the second loading zone can be moved into place at the start of the zipline 110 by moving in the direction of arrow B. it should be clear that these directions are merely exemplary, and different directions of movement are possible. FIG. 11B shows a schematic view of multiple loading zones with the second loading zone moved into place at the start of the zipline, according to an illustrative embodiment. The first loading zone 1110 has been moved away from the zipline, and the second loading zone 1120 has been moved into place, abutting the zipline 110. A rider that has been loaded on second loading zone 1120 is now positioned to take off immediately onto the zipline 110. This system of multiple loading zones can greatly reduce downtime between riders.

The system described herein can allow for exciting and high-speed rides that can take place within a confined area, such as an amusement park or even a cruise ship. By way of non-limiting example, a zipline path can extend out over the edge of a cruise ship, with the centrifugal force pulling the rider out past the edge of the ship and back again.

Although this invention has been disclosed in the context of certain preferred embodiments and examples, it therefore will be understood by those skilled in the art that the present invention extends beyond the specifically disclosed embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

Some embodiments, illustrating its features, will now be discussed in detail. The words "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

References to "one embodiment", "an embodiment", "another embodiment", "one example", "an example", "another example" and so on, indicate that the embodiment(s) or example(s) so described may include a particular feature, structure, characteristic, property, element, or limitation, but that not every embodiment or example necessarily includes that particular feature, structure, characteristic, property, element or limitation.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, in various embodiments, different forms of support can be used including stand-alone supports at transition rails. Also, as used herein, various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances (e.g. 5%) of the system. Accordingly, this description is meant to be taken only by way of example, and not to otherwise limit the scope of this invention.

What is claimed is:

1. A zip line system, comprising:

a cable;

a trolley adapted to ride on the cable;

a turn rail supported by a plurality of spokes, the turn rail configured for the trolley to travel on the turn rail in a curved path; and a guide rod attached to the turn rail via a plurality of spacers and adapted to provide correct angling of the trolley during turns and preventing collisions of the trolley with the spokes, wherein the trolley includes:

a main body;

an upper wheel having an upper waist section, the upper wheel attached to the main body via an upper trolley axle; and a lower wheel having a waist section, the lower wheel attached to the main body via a lower trolley axle, wherein the upper wheel waist section and the lower wheel waist section define a zipline passage between the waist sections of the wheels, the zipline passage adapted to accommodate the cable and adapted to accommodate a turn rail; and wherein the upper wheel includes an upper inner wider region and the lower wheel includes a lower inner wider region, and wherein the upper inner wider region and the lower inner wider region define a guide gap adapted to accommodate a guide rod, wherein the guide rod passes through the guide gap and guides the orientation angle of the trolley as the trolley travels around the turn rail.

2. The zip line system of claim 1, wherein the upper wheel includes an upper outer wider region and the lower wheel includes a lower outer wider region, and wherein the upper outer wider region and the lower outer wider region define a support gap adapted to accommodate a spoke, wherein the guide rod guides the orientation angle of the trolley so that the support spokes pass through the support gap as the trolley travels around the turn rail.

3. The zip line system of claim 2, further comprising a sheath over the cable, and wherein the upper outer wider region and the lower outer wider region are close enough together to prevent the sheath over the cable from passing through the support gap.

4. The zipline system of claim 1, further comprising a translucent sheath over the cable, and wherein a series of LEDs inside the translucent sheath make the sheath emit light.

5. A trolley for traveling on a zipline with a turn comprising:

a main body;

an upper wheel having an upper waist section, the upper wheel attached to the main body via an upper trolley axle; and a lower wheel having a waist section, the lower wheel attached to the main body via a lower trolley axle, wherein the upper waist section and the lower wheel waist section define a zipline passage between the waist sections of the wheels, the zipline passage adapted to accommodate a zipline and adapted to accommodate a turn rail;

wherein the upper wheel includes an upper inner wider region and the lower wheel includes a lower inner wider region, and wherein the upper inner wider region and the lower inner wider region define a guide gap adapted to accommodate a guide rod, wherein the guide rod is adapted for the guide rod pass through the guide gap and guide the orientation angle of the trolley as the trolley travels around a turn.

6. The zipline system of claim 5, wherein the upper wheel includes an upper outer wider region and the lower wheel includes a lower outer wider region, and wherein the upper outer wider region and the lower outer wider region define a support gap adapted to accommodate a spoke, wherein the guide rod guides the orientation angle of the trolley so that the support spokes pass through the support gap as the trolley travels around the turn.

7. A method of using a zipline comprising:

suspending a rider below a trolley, the trolley adapted to ride on a cable and the trolley comprising:

a main body, an upper wheel having an upper waist section, the upper wheel attached to the main body via an upper trolley axle; and a lower wheel having a waist section, the lower wheel attached to the main body via a lower trolley axle, wherein the upper wheel waist section and the lower wheel waist section define a zipline passage between the waist sections of the 9 wheels, the zipline passage adapted to accommodate the cable and adapted to accommodate a turn rail;

travelling along the cable with the rider suspended below the trolley and the trolley riding on the cable;

entering a turn section, the turn section comprising:

a turn rail; and a guide rod, wherein the guide rod passes between the upper wheel and the lower wheel, and guides the angle of the trolley as the trolley travels around the corner; wherein as the trolley enters the turn section, the trolley transitions from riding on the cable to riding on the turn rail; and swinging outwards under centrifugal force while travelling around the turn section.

* * * * *